US005752284A

United States Patent [19]

Dabney et al.

[11] Patent Number: 5,752,284

[45] Date of Patent: May 19, 1998

[54] SPRING TO METAL RAIL CONNECTION

[75] Inventors: Upton R. Dabney, Richmond; John P. Kitchen; William C. Rodgers, both of Georgetown, all of Ky.

[73] Assignee: L&P Property Management Co., South Gate, Calif.

[21] Appl. No.: 853,667

[22] Filed: May 9, 1997

Related U.S. Application Data

[63] Continuation-in-part of Ser. No. 626,044, Apr. 1, 1996, Pat. No. 5,639,071.

[51] Int. Cl.[6] ..... A47C 23/00; A47C 23/04

[52] U.S. Cl. ..... 5/264.1; 5/247; 267/103

[58] Field of Search ..... 5/264.1, 263, 255, 5/265, 247; 267/100, 103, 106, 107; 29/91.1

[56] References Cited

U.S. PATENT DOCUMENTS

| | | | |
|---|---|---|---|
| 259,192 | 6/1882 | Mock . | |
| 1,014,736 | 1/1912 | Young . | |
| 1,124,031 | 1/1915 | Kohler . | |
| 1,127,198 | 2/1915 | D'Arcy | 5/264.1 |
| 1,225,148 | 5/1917 | Mahoney . | |
| 1,270,238 | 6/1918 | Falls . | |
| 1,399,028 | 12/1921 | Smith | 5/264.1 |
| 1,497,967 | 6/1924 | Young . | |
| 2,119,368 | 5/1938 | Travis . | |
| 2,332,042 | 10/1943 | Asaro | 5/264.1 |
| 2,593,831 | 4/1952 | Bank . | |
| 2,642,932 | 6/1953 | Neely et al. | 5/264.1 |
| 2,842,188 | 7/1958 | Hupp . | |
| 2,871,922 | 2/1959 | Stubnitz et al. . | |
| 3,680,157 | 8/1972 | Slominski . | |
| 3,750,201 | 8/1973 | Usami . | |
| 3,971,081 | 7/1976 | Roe . | |
| 4,102,586 | 7/1978 | Pearson et al. . | |
| 4,218,790 | 8/1980 | Mizelle . | |
| 4,251,892 | 2/1981 | Hancock . | |
| 4,470,584 | 9/1984 | Mizelle . | |
| 4,577,841 | 3/1986 | Hagemeister . | |
| 4,592,106 | 6/1986 | Hagemeister . | |
| 4,675,927 | 6/1987 | Mizelle . | |
| 4,779,292 | 10/1988 | Dabney | 5/264.1 |
| 4,861,002 | 8/1989 | Dabney | 5/264.1 |
| 5,054,751 | 10/1991 | Brown . | |
| 5,176,367 | 1/1993 | Rodgers et al. | 5/247 |
| 5,519,903 | 5/1996 | Constantinescu . | |

*Primary Examiner*—Alexander Grosz
*Attorney, Agent, or Firm*—Wood, Herron & Evans, L.L.P.

[57] ABSTRACT

A spring assembly comprising a frame, a plurality of rails secured to the frame and a plurality of spaced springs secured to the rails. Each of the rails has a generally U-shaped cross-section and comprises a bottom and two sidewalls. Each sidewall has an inwardly projecting detent creating a receptacle underneath the detent adapted to receive and hold a spring. Each of the springs has a substantially planar lower portion which is generally S-shaped and adapted to be positioned in the receptacles of the sidewalls of the rail and rotated into a snap-fit locked position. In this locked position, the detents of the sidewalls hold the lower portion of the spring against the bottom of the rail and prevent lateral or vertical movement of the spring.

18 Claims, 4 Drawing Sheets

SPRING TO METAL RAIL CONNECTION

RELATED APPLICATIONS

This application is a continuation-in-part of Ser. No. 08/626,044 filed on Apr. 1, 1996, now U.S. Pat. No. 5,639,071, assigned to the assignee of the present application.

BACKGROUND OF THE INVENTION

This invention relates to support rails used in spring assemblies such as bedding foundations, seat assemblies and the like and to springs having a lower portion adapted to be held in a snap-fit locked position inside the support rails.

DESCRIPTION OF THE PRIOR ART

Generally, a box spring assembly includes a rectangularly shaped and horizontally positioned frame above which is supported a mattress support deck. A plurality of spring modules are interposed between the frame and the deck to support a load distributed along the deck. At their upper ends, the spring modules include deck attaching portions which interact with the deck so as to attach the modules to the deck. At their lower ends, the spring modules typically have either one or a pair of mounting feet for attachment to rails which extend either longitudinally of the frame or transversely across the frame. A grid-like network of deck wires and a generally rectangular border wire comprises the deck. The deck wires extend both longitudinally and transversely between and are attached to the border wire. The spring modules yieldably support the deck a pre-determined distance above the frame.

Most often, the frame itself is formed of wood and has a perimeter comprising two side members and two end members. Spaced rails may extend transversely across the width of the frame or longitudinally along the length of the frame and are formed out of either metal or wood. Depending on the type of rail, the mounting feet of the springs are secured to the rails by various methods. If the rails are wooden, the mounting feet of the springs are generally stapled in place on the rails. If the rails are constructed of metal, the rails typically have an inverted U-shaped cross-section and a top and two sidewalls. The mounting feet of the springs to be secured to the metal rails are typically horizontally oriented U-shaped wires which are inserted into slots formed in the sidewalls of the rails.

Several patents such as U.S. Pat. Nos. 4,218,790; 4,861,002; and 4,779,292 disclose spring modules having one or more generally horizontally oriented lower or foot portions adapted to be inserted and held inside a metallic rail. These metallic rails have an inverted U-shaped cross-section with a generally horizontal flat upper portion and two downwardly extending sidewalls. Slots are punched in the two sidewalls at spaced locations in order to accept the mounting feet of the spring modules. The mounting feet of the spring modules each typically comprises a generally U-shaped wire which is compressed and then inserted into one of the slots of the sidewalls of the rails. When the compression is released the legs of the U-shaped wire move outwardly causing a friction fit of the foot portion within a slot of the rail holding the spring module to the rail. U.S. Pat. Nos. 4,861,002 and 4,779,292 both disclose spring modules having two mounting feet both inserted into a metallic rail through horizontally oriented slots in the sidewalls of the rail. This type of connection between a metallic rail having slotted sidewalls and a horizontally oriented foot portion of a spring module requires that the rail sidewalls be slotted and the mounting feet of the spring modules be U-shaped wires. Therefore, a need exists for a rail capable of receiving and securing therein one or more mounting feet of a spring module which are not U-shaped wires.

U.S. Pat. No. 5,176,367 discloses spring modules each having a vertically oriented mounting foot secured to a wooden slat with the use of one or more staples. The use of staples to secure a substantially vertically oriented foot portion of a spring module to a crossing slat or rail works fine if the rail is made of wood but if the rail is made of metal, this type of attachment will not work. U.S. Pat. No. 1,124,031 does disclose a spring having a substantially vertically oriented lower mounting portion 10 inserted into a metallic rail, the metallic rail having a series of slots therein. This type of attachment is fine but does not lock the spring to the rail. By simply lifting the spring upwardly, the spring can separate from the rail. Therefore, a need exists for a connection between a metallic rail and a mounting portion of a spring such that the spring may not easily become separated from the rail.

Therefore, it has been one objective of the present invention to provide a spring assembly having a plurality of spring modules with mounting feet which may be lockingly secured to metal rails.

It has been a further objective of the present invention to provide a metallic rail having a U-shaped cross-section adapted to receive a mounting foot of a spring module.

It has further been an objective of the present invention to provide a spring module which may be positioned inside a metal rail and rotated into a snap-fit locked position in which the spring module is united with the metal rail.

SUMMARY OF THE INVENTION

The invention of this application which accomplishes these objectives comprises a spring assembly comprising a frame, a plurality of metal rails secured to the frame and a plurality of spaced springs secured to the rails. The frame is generally rectangular having two end pieces and top opposed side pieces usually made of wood. The rails of the present invention are metallic and may extend transversely from one side member of the frame to the other side member of the frame or may extend longitudinally of the frame from one end member of the frame to the other end member of the frame. Each of the rails has a generally U-shaped cross-section comprising a bottom and two opposed substantially vertically oriented sidewalls. Each sidewall has an inwardly projecting detent creating a receptacle underneath the detent adapted to receive and hold a foot portion of a spring. The width across the rail from the detent of one sidewall to the detent of the other sidewall defines a neck of the rail.

A plurality of springs are secured to the rails and are spaced along the lengths of the rails. Each of the springs has a substantially planar lower portion, a substantially planar upper portion and two legs connecting the upper and lower portions. The lower portion is generally S-shaped and adapted to be positioned in the receptacles of the sidewalls of the rail. In order to secure the spring inside the rail, the spring may be rotated into a snap-fit locked position in which the detents of the sidewalls of the rails hold the lower portion of the spring against the bottom of the rail and prevent the spring from being lifted up away from the rail.

Each of the springs of the present invention comprises a substantially planar lower portion having a generally S-shaped configuration, two legs extending upwardly from the substantially planar lower portion of the spring and a substantially planar upper portion comprising two slightly arcuate sections, one arcuate section extending outwardly from each of the legs of the spring. The legs of the spring may be of any configuration but are illustrated in the drawings as being substantially straight.

The upper portion of each spring is connected to a substantially planar upper deck. The upper deck comprises a generally rectangular border wire and criss-crossing wire deck members extending both longitudinally and transversely forming a grid type structure. The ends of the deck members are secured to the border wire.

The lower portion of each spring comprises a first and second bar, a middle bar and two connector bars. Each connector bar connects one end of the middle bar to one of either the first or second bars. The first, second and middle bars are substantially parallel and the two connector bars are substantially parallel. The distance between the connector bars is less than the distance between the first and second bars so that the lower portion of the spring is able to pass through the neck of the rail only if the connector bars are aligned with and substantially parallel the sidewalls of the rail. The distance between the connector bars is slightly larger than the length between the detents of the rail sidewalls or neck, enabling the lower portion of the spring to be pushed downwardly past the detents and snapped into a secured position inside the interior of the rail. Once the lower portion of the spring is passed downwardly through the neck of the rail, the spring module is rotated approximately 10°–20° causing the connector bars to rotate out from under the detents of the rail sidewalls and causing the first and second bars to rotate into the receptacles of the sidewalls of the rail into a snap-fit locked position. In this snap-fit locked position, the spring may not be lifted upwardly away from the rail because the detents force the lower portion of the spring downwardly against the bottom of the rail. The width of the neck of the rail is less than the distance between the first and second bars of the lower portion of the spring thereby holding the lower portion of the spring against the bottom of the rail and preventing separation of the rail and the spring. This type of spring bottom enables a spring to be snapped into place inside the rail and rotated slightly into a snap-fit locked position.

These and other objects and advantages of this invention will become more readily apparent from the following description of the drawings in which:

DESCRIPTION OF THE PREFERRED EMBODIMENT

Figure 1:
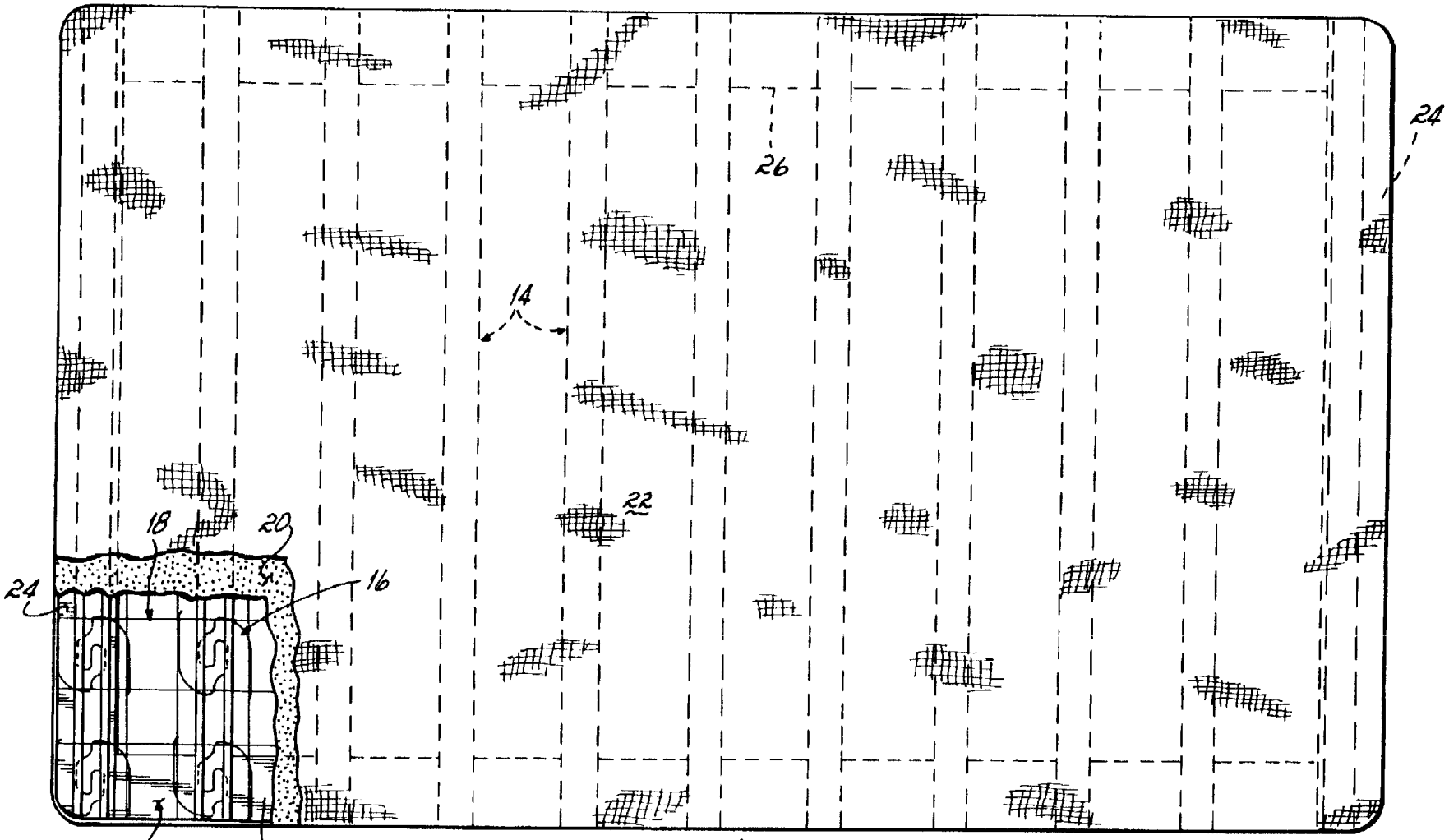
FIG. 1 is a top plan view, partially broken away of a bedding foundation incorporating the invention of this application.
Figure 2:
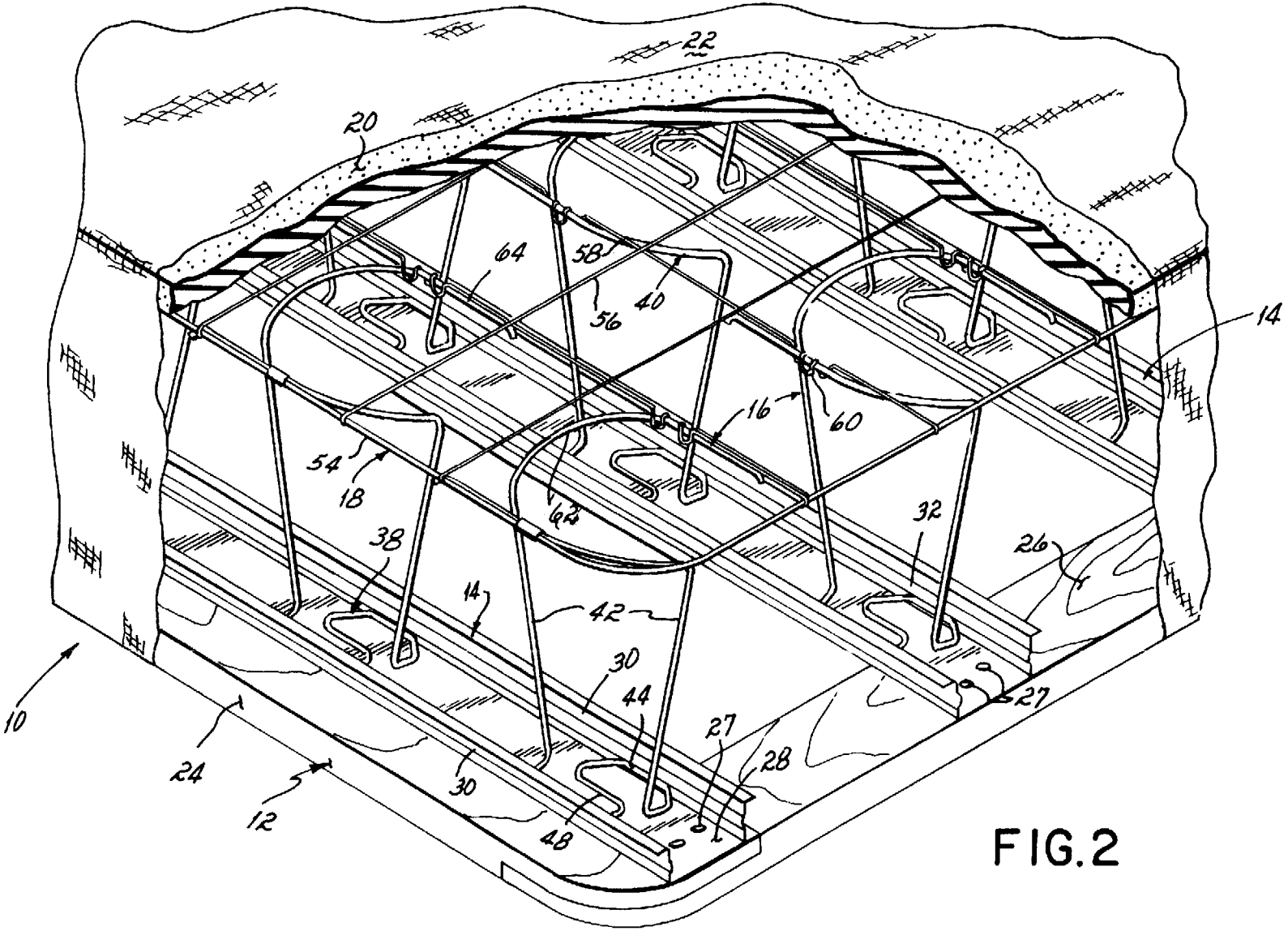
FIG. 2 is a fragmentary perspective view, partially broken away of one corner of the bedding foundation of FIG. 1.

Referring to the drawings and particularly to FIGS. 1 and 2, there is illustrated a bedding foundation 10 comprising a generally rectangular frame 12, a plurality of rails 14 secured to the frame, a plurality of springs 16 secured to the rails, a deck or wire grid 18 secured to the upper portions of the springs, a mattress pad 20 and an upholstered covering 22. Although FIG. 1 illustrates a bedding foundation, the present invention may be used in automotive seating, furniture and various other applications.

Figure 3:
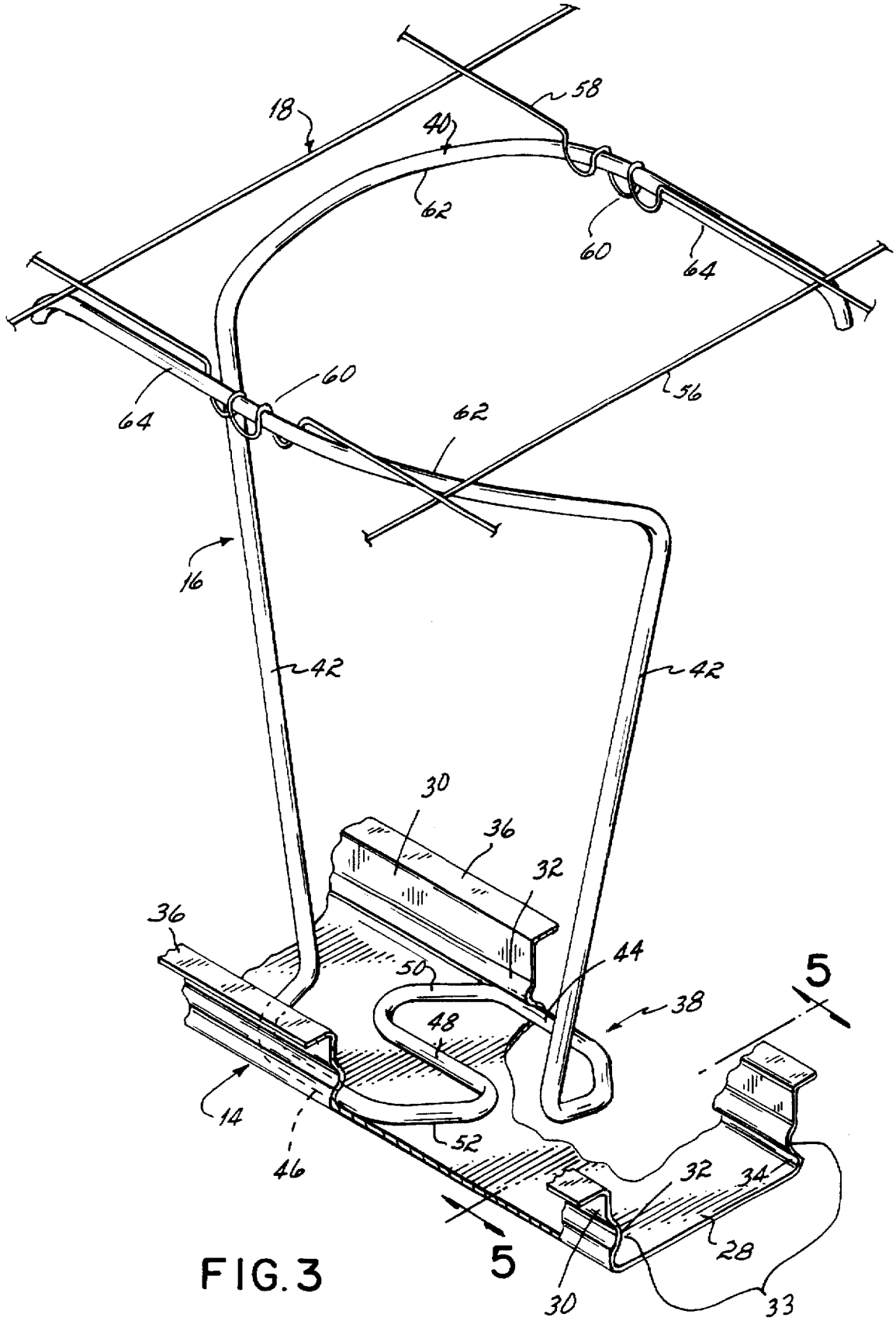
FIG. 3 is an enlarged perspective view of a spring of the present invention in a locked position inside a rail of the present invention.

If the present invention is used in a bedding application as illustrated in FIG. 1, the frame 12 is generally rectangular having two end pieces 24 and two side pieces 26. The rails 14 may extend transversely of the frame from one side piece 26 of the frame to the other side piece 26 of the frame as illustrated in FIGS. 1 and 2, or, alternatively, the rails 14 may extend longitudinally from one end piece 24 of the frame to the other end piece 24 of the frame. The rails of the present invention are made of metal and are secured to the frame 12 with one or more securements 27 which may be nails, screws or any other conventional fasteners. Usually the frame is made of wood but may be made of any material. Each of the rails 14 has a generally U-shaped cross-section and comprises a substantially horizontal bottom 28 and two substantially vertical sidewalls 30. Each sidewall 30 has a inwardly projecting detent 32 creating a receptacle 34 underneath the detent 32 between the detent 32 and the bottom 28 of the rail. The lateral distance between the two detents 32 defines a neck 33 which is the location in which the sidewalls 30 are closest to each other. As illustrated in FIG. 3, the detents 32 and receptacles 34 are shaped so as to enable a spring 16 to be pressed downwardly past the detents 32 into the receptacles 34 and rotated into a snap-fit locked position. An upper portion of each sidewall 30 comprises a substantially horizontal outwardly extending flange 36.

Spaced between the deck 18 and the frame 12 are a plurality of springs 16. The springs 16 are secured to the rails 14 at spaced locations along the rails and also secured to the deck 18. The springs 16 yieldably support a load placed on the deck. Each of the springs 16 has a substantially planar lower portion 38, a substantially planar upper portion 40 and two legs 42 connecting the upper portion 40 to the lower portion 38.

The lower portion 38 of each spring 16 is generally S-shaped and adapted to be positioned inside the receptacles 34 of the sidewalls 30 of the rails 14 and rotated into a snap-fit locked position in which the detents 32 hold the lower portion 38 of the spring 16 against the bottom 28 of the rail and prevent the spring from moving laterally or being lifted away from the rail 14. The S-shaped lower portion 38 of spring 16 comprises a first bar 44, a second bar 46, a middle bar 48 and two connector bars 50, 52. Each of the connector bars 50, 52 connects one end of the middle bar 48 to one of the first or second bars. The first and second bars 44, 46 are substantially parallel with the middle bar 48 and define a linear distance D1 between the outermost portion of the first bar and the outermost portion of the second bar 46. Likewise, the two connector bars 50, 52 are substantially parallel to one another and define a linear distance D2 between the outermost portions of the connector bars 50, 52. The distance D1 between the first and second bars is larger than the distance D2 between the connector bars for purposes of inserting and securing the lower portions of the springs to the rails 14 at select locations along the rails 14.

Figure 4:
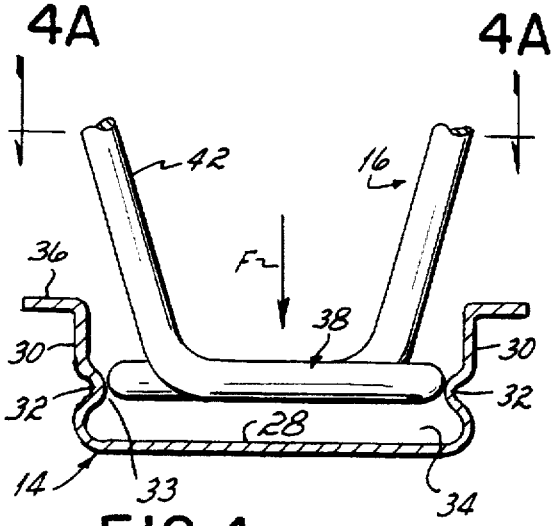
FIG. 4 is a cross-sectional view of the spring and rail of FIG. 3, the spring being pushed downwardly past the neck of the rail, the connector bars of the spring resting on the detents of the sidewalls of the rail.
Figure 4A:
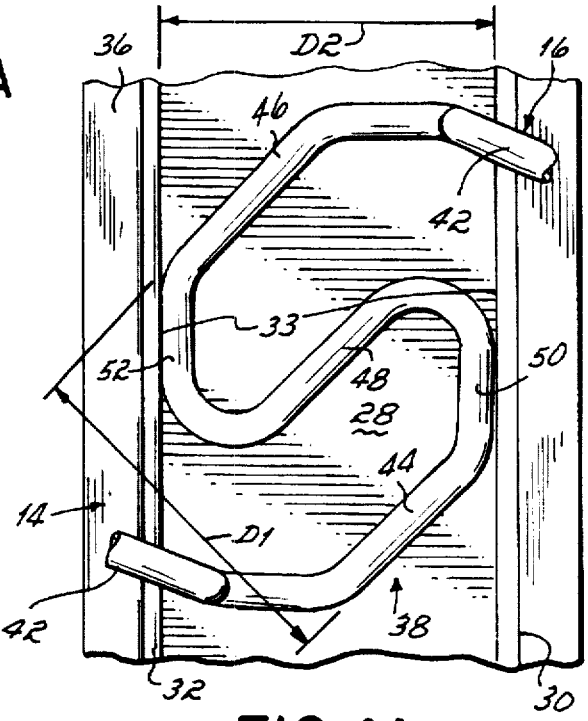
FIG. 4A is a view taken along the lines 4A—4A of FIG. 4.

As illustrated in FIG. 1, the springs 16 are positioned along the length of rails 14 in selected desired locations. The springs 16 are positioned above the rails 14 and the lower portions 38 of the springs 16 aligned such that the two connector bars 50, 52 of each spring are substantially parallel the sidewalls 30 of the rail 14. The distance D2 between the connector bars 50, 52 is slightly larger than the width between the detents of the sidewalls or neck of the rail. Because the tops of the rail sidewalls are not secured to anything, the sidewalls are flexible and may move laterally. When a downward force F is applied to the spring 16 as illustrated in FIG. 4, the rail sidewalls 30 move outwardly slightly enabling the lower portion 38 of the spring to pass through the neck 33 of the rail 14 and rest against the bottom 28 of the rail 14. Once the lower portion 38 of the spring has passed through the neck 33 of the rail and into the receptacles 34, the sidewalls move inwardly slightly to their at rest position.

Figure 5:
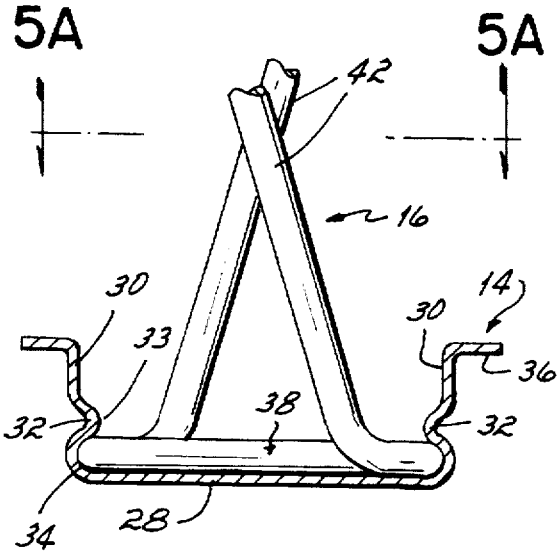
FIG. 5 is a cross-sectional view of the spring and rail of FIG. 3 in a locked position taken along the lines 5—5 of FIG. 3.
Figure 5A:
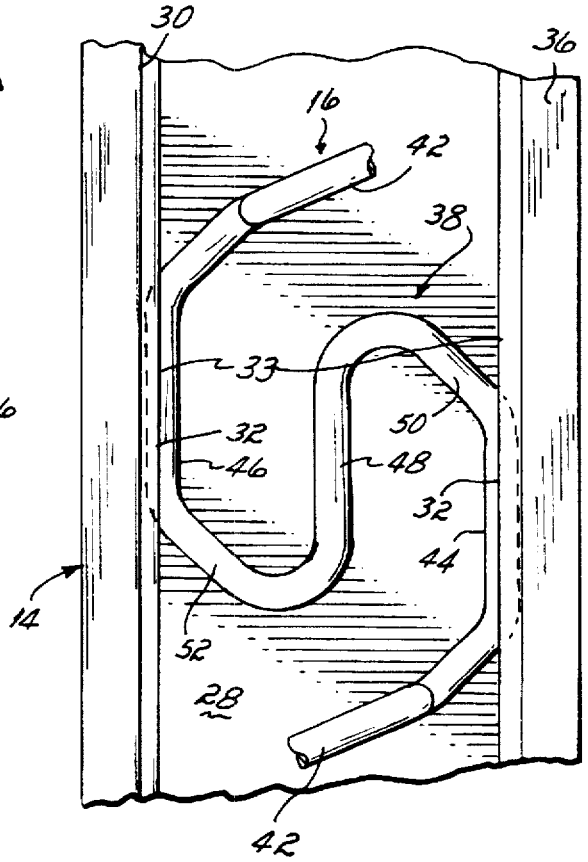
FIG. 5A is a view taken along the lines 5A—5A of FIG. 5, the spring being held in a locked position by the detents of the rail sidewalls.

Referring to FIGS. 5 and 5A, after the lower portion 38 of the spring passes through the neck 33, the spring 16 is rotated approximately 10°–20° causing the connector bars 50, 52 to move out from under the sidewall detents 32 and out of the receptacles 34 of the sidewalls 30. This slight counter-clockwise movement of the spring 16 causes the first and second bars 44, 46 of the lower portion 38 of the spring to pass into the receptacles 34 of the sidewalls 30 into a snap-fit locked position in which the lower portion 38 of the spring 16 is held against the bottom 28 of the rail 14 by the detents 32 in the sidewalls. Although the drawings illustrate the lower portion of the spring to be rotated counter-clockwise into a snap-fit locked position of FIG. 5A, the springs could just as well be manufactured and oriented such that a clockwise rotation would cause them to move into a snap-fit locked position in the rails. As illustrated in FIG. 5A, in this locked position, the first and second bars 44, 46 of the lower portion 38 of the spring 16 extend slightly outward beyond the detents 32 of the rail preventing the spring from being lifted away from the rail. The spring 16 is locked in this position until the spring 16 is rotated again the opposite direction causing the first and second bars 44, 46 to rotate out of the receptacles 34 and the connector bars 50, 52 to again be aligned with the rail sidewalls 30. In this position with the connector bars aligned with the sidewalls 30, the spring 16 may be lifted away from the rail and removed. Thus, the spring and rail connection of the present invention is configured such that simply by rotating the spring slightly, the spring may move between a locked position in which it is secured to the rail and an unlocked position in which the spring may be lifted away from the rail.

In addition to the specific lower portion described hereinabove, each of the springs 16 is illustrated as having two substantially straight legs 42, each leg 42 extending upwardly from the lower portion 38 of the spring 16 to the upper portion 40 of the spring 16. The present invention is not intended to be limited to straight legs and any other type of leg may be utilized in accordance with the present invention. The upper portion 40 of each spring comprises two arcuate sections 62 and two substantially straight portions 64, the straight portions 64 being secured to the deck 18.

As best illustrated in FIG. 2, a deck 18 is spaced a fixed distance above the frame 12 and rails 14 by a plurality of springs 16. The deck 18 comprises a grid like structure comprising a generally rectangular border wire 54 and a plurality of spaced parallel longitudinal members 56 and a plurality of spaced parallel transverse members 58. The ends of the longitudinal and transverse members 56, 58 are secured to the border wire 54 by being looped around the border wire or secured in any other fashion such as welding. Likewise, the transverse and longitudinal members 56, 58 may be welded to each other at their points of intersection.

As illustrated in FIG. 3, the transverse members 58 of the deck may have crimps 60 therein securing the planar upper portion 40 of the spring 16 to the deck 18. Any other securement device may likewise be utilized to secure the deck to the upper portions of the springs such as clips or welds. Likewise, the upper portions 40 of the springs 16 themselves may be crimped and the transverse members 58 of the deck 18 straight and uncrimped.

While we have described one preferred embodiment of the present invention, persons skilled in the art will appreciate changes and modifications which may be made without departing from the spirit of the invention. For example, it is anticipated that other rails such as the channel shaped rail of the assignee's copending patent application Ser. No. 08/626,044 may be used in lieu of the specific rail illustrated and disclosed in this application. Therefore, we do not intend to be limited except by the scope of the following appended claims.

What is claimed is:

1. A bedding foundation comprising:

a spring assembly comprising a frame, a plurality of rails secured to said frame, each of said rails having a generally U-shaped cross section and comprising a bottom and two sidewalls, each sidewall having an inwardly projecting detent creating a receptacle underneath said detent adapted to receive and hold therein a spring, a plurality of spaced springs secured to said rails, each of said springs having a substantially planar lower portion, a substantially planar upper portion and two legs connecting said upper and lower portions, said lower portion being generally S-shaped and adapted to be positioned in said receptacles of said sidewalls of a rail and rotated into a snap-fit locked position in which said detents hold said lower portion of said spring against said bottom of said rail and prevent said spring from being lifted away from said rail, a pad overlying said upper portions of said springs, an upholstered covering surrounding said pad and spring assembly.

2. A spring assembly comprising:

a frame, a plurality of rails secured to said frame, each of said rails having a generally U-shaped cross section and comprising a bottom and two sidewalls, each sidewall having an inwardly projecting detent creating a receptacle underneath said detent adapted to receive and hold therein a spring, a plurality of spaced springs secured to said rails, each of said springs having a substantially planar lower portion, a substantially planar upper portion and two legs connecting said upper and lower portions, said lower portion being generally S-shaped, and adapted to be positioned in said receptacles of said sidewalls of a rail and rotated into a snap-fit locked position in which said detents hold said lower portion of said spring against said bottom of said rail and prevent said spring from being lifted away from said rail.

3. The spring assembly of claim 2 further comprising a top grid said top grid being secured to said upper portions of said springs.

4. The spring assembly of claim 2 wherein each of said springs is formed of one piece of wire, said upper portions of said springs each comprising two arcuate sections, one arcuate section extending outwardly from each of said legs.

5. The spring assembly of claim 2 wherein said rails extend transversely of said frame.

6. The spring assembly of claim 2 wherein each of said lower portions of said springs comprises a first and second bar, a middle bar, and two connector bars, each connector bar connecting one end of said middle bar to one of said first and second bars, said first, second and middle bars being substantially parallel and said connector bars being substantially parallel.

7. The spring assembly of claim 6 wherein the distance between said connector bars is less than the distance between said first and second bars such that said lower portion of said spring may pass between said detents only if said connector bars are aligned with and substantially parallel said sidewalls of said rail enabling said lower portion of said spring to be snapped into and secured inside said rail.

8. The spring assembly of claim 6 wherein said first and second bars are held in said receptacles by said detents, the distance between said first and second bars being greater than the distance between said detents.

9. A spring assembly comprising:

a generally rectangular frame comprising two side members and two end members, a plurality of rails extending between and secured to said side members of said frame, selected of said rails having a U-shaped cross section with a pair of sidewalls and a bottom, each sidewall having an inwardly projecting detent creating a receptacle underneath said detent, the detents defining a neck of the rail, said neck being of a width less than the width between said receptacles, a plurality of spaced springs secured to said selected rails, each of said springs having a generally S-shaped planar lower portion, said lower portion being able to pass through a neck of a rail only if oriented in a certain way, enabling said lower portion to be secured in said receptacles of said selected rails by rotating said lower portion once said lower portion has passed downwardly through said neck of said rail.

10. The spring assembly of claim 9 wherein said lower portion of each spring comprises a substantially parallel first bar, a second bar, a middle bar, and two substantially parallel connector bars, each connector bar connecting one end of said middle bar to one of said first and second bars, the distance between said connector bars being less than the width of said neck such that in order for said lower portion of said spring to pass below said neck into said receptacles, said connector bars must be generally parallel said sidewalls of said rail.

11. The spring assembly of claim 9 wherein each of said springs has a planar upper portion and two legs, each leg connecting one end of said lower portion of said spring to said upper portion.

12. The spring assembly of claim 1 1 further comprising a top grid comprising crisscrossing grid members, said top grid being secured to said upper portions of said springs.

13. The spring assembly of claim 12 wherein said top grid is secured to said upper portions of said springs by crimps in selected of said grid members.

14. The spring assembly of claim 11 wherein each of said springs is formed of one piece of wire, said upper portions of said springs each comprising two arcuate sections, one arcuate section extending from each of said legs.

15. A method of securing a spring to a rail, said spring having a generally S-shaped, substantially planar lower portion comprising substantially parallel first and second bars, a middle bar and two substantially parallel connector bars, each of said connector bars connecting one end of said middle bar to one of said first and second bars, said rail having a generally U-shaped cross section and comprising a bottom and first and second sidewalls, each sidewall having an inwardly projecting detent creating a receptacle underneath said detent, aligning said spring above said rail such that said connector bars of said lower portion of said spring are aligned with and generally parallel said sidewalls of said rail, pushing said spring downwardly, forcing said lower portion of said spring past said detents of said sidewalls such that said connector bars rest in said receptacles of said rail, rotating said spring until said first and second bars of said spring are inside said receptacles beneath said detents, the distance between said detents being less than the distance between said first and second bars, preventing said spring from separating from said rail.

16. The method of claim 15 wherein said spring is rotated approximately 10 to 20 degrees, causing said connector bars to rotate out from underneath said detents and causing said first and second bars to pass into said receptacles.

17. A method of assembling a bedding foundation, said method comprising:

providing a frame and a plurality of rails secured to said frame, each rail having a generally U-shaped cross section and comprising a bottom and first and second sidewalls, each sidewall having an inwardly projecting detent creating a receptacle underneath said detent, providing a plurality of springs, each spring having a generally S-shaped, substantially planar lower portion comprising substantially parallel first and second bars, a middle bar and two substantially parallel connector bars, each of said connector bars connecting one end of said middle bar to one of said first and second bars, aligning said springs above said rails such that said connector bars of said springs are aligned with said sidewalls of said rails, pushing said springs downwardly, forcing said lower portions of said springs past said detents of said sidewalls such that said connector bars rest in said receptacles of said sidewalls of said rails, rotating each of said springs until said first and second bars of each spring are inside said receptacles beneath said detents, the distance between said detents being less than the distance between said first and second bars, preventing the spring from separating from the rail.

18. The method of claim 17 wherein each spring is rotated approximately 10 to 20 degrees, causing said connector bars to rotate out from underneath said detents and causing said first and second bars to pass into said receptacles.

* * * * *